US005900888A

United States Patent [19]

Kurosawa

[11] Patent Number: 5,900,888

[45] Date of Patent: May 4, 1999

[54] PRINTING APPARATUS AND FACSIMILE APPARATUS USING SAME

[75] Inventor: Yuji Kurosawa, Tokyo, Japan

[73] Assignee: Canon Kabushiki Kaisha, Tokyo, Japan

[21] Appl. No.: 08/662,949

[22] Filed: Jun. 13, 1996

[30] Foreign Application Priority Data

Jun. 19, 1995 [JP] Japan ..... 7-151481

[51] Int. Cl.[6] ..... B41J 2/195

[52] U.S. Cl. ..... 347/7; 347/14

[58] Field of Search ..... 347/6, 7, 23, 37, 347/14, 17, 19

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,432,005 | 2/1984 | Duffield et al. | 347/7 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,068,806 | 11/1991 | Gatten | 347/7 |
| 5,250,957 | 10/1993 | Onozato | 347/7 |
| 5,623,290 | 4/1997 | Iida et al. | 347/7 |
| 5,638,097 | 6/1997 | Takayanagi et al. | 347/7 |

FOREIGN PATENT DOCUMENTS

| | | | |
|---|---|---|---|
| 54-056847 | 5/1979 | Japan . | |
| 56-144184 | 11/1981 | Japan . | |
| 59-123670 | 7/1984 | Japan . | |
| 59-138461 | 8/1984 | Japan . | |
| 60-071260 | 4/1985 | Japan . | |
| 2102061 | 4/1990 | Japan . | |
| 6-15843 | 1/1994 | Japan | 347/7 |
| 6-226989 | 8/1994 | Japan | 347/7 |

*Primary Examiner*—Christopher A. Bennett
*Attorney, Agent, or Firm*—Fitzpatrick, Cella, Harper & Scinto

[57] ABSTRACT

A printer and facsimile apparatus using the printer capable of detecting residual ink in an ink cartridge with higher precision by eliminating influence of ripples of ink surface due to the movement of an ink cartridge or influence of noise. Reflective type photosensor 11 detects residual ink in ink cartridge 9, and the detection result is current/voltage-converted. Smoothing circuit 152 smoothes the converted detection result including the influence of the trembles of ink surface and the mixing of noise. Then the smoothed voltage is A/D converted and forwarded to processing by CPU 101.

33 Claims, 8 Drawing Sheets

PRINTING APPARATUS AND FACSIMILE APPARATUS USING SAME

BACKGROUND OF THE INVENTION

This invention relates to a printing apparatus and facsimile apparatus using the printing apparatus and, more particularly to a printing apparatus that performs printing in accordance with an ink-jet printing method and facsimile apparatus using the printing apparatus.

Conventionally, printers that perform printing in accordance with an ink-jet printing method employ various techniques as described below to detect the amount of residual ink in their ink tank.

Japanese Patent Application Laid-Open No. 2-102061 discloses a reflective type photosensor, with a reflection board provided in an ink tank, to detect shortage of ink. In Japanese Patent Application Laid-Open No. 56-144184, to avoid degradation of detection precision due to ripples of the ink surface, ink shortage status is detected after a predetermined period from stop of a carridge movement.

Further, for the residual ink detection, a current/voltage converter for converting a detected current into a voltage, and an A/D converter for converting the obtained analog voltage into a digital value are employed as well as a photosensor.

However, for the residual ink detection, to detect a photosensor output, the above prior art uses a circuit which requires adjustment due to fluctuation of the sensor output, the secular change of sensor characteristic, and variation in sensing mechanism, which exceed allowable values. Further, as the ink cartridge itself trembles due to vibration of the apparatus or the like, noise may be mixed in the residual-ink detection. Otherwise, in apparatuses where the ink cartridge integrated with the printhead into the carriage moves at each printing operation, the sensor output varies due to ripples of the ink surface, thus degrading the precision of residual-ink detection.

SUMMARY OF THE INVENTION

Accordingly, it is an object of the present invention to provide a printing apparatus that detects the amount of residual ink with high precision, without fine adjustment, and further, regardless of detection-hindrance factors such as ripples of the ink surface or mixture of external noise, without causing load upon the apparatus. In this apparatus, the detection mechanism of the printer has other functions such as checking attached status of the ink tank and discriminating an unexpected stream of external sunlight coming through a slit or opening.

According to one aspect of the present invention, the foregoing object is attained by providing a printer which scans a printhead, discharges ink from the printhead and performs printing on a printing medium, comprising: scan means for scanning the printhead; an ink tank, containing the ink, being detachably attached to the printer, and scanned, integrally with the printhead, by the scan means; detection means for detecting an amount of residual ink in the ink tank; memory means for storing a predetermined threshold value (X) for determination on the amount of residual ink in the ink tank; smoothing means for smoothing variation in the result of detection by the detection means; comparison means for comparing the detection result smoothed by the smoothing means with the predetermined threshold value (X); and first determination means for determining whether or not the ink remains in the ink tank, in accordance with the result of comparison by the comparison means.

It is another object of the present invention to provide a facsimile apparatus using the above printing apparatus.

According to another aspect of the present invention, the foregoing object is attained by providing a facsimile apparatus using the printer having the above construction.

It is still another object of the present invention to provide a method for detecting the amount of residual ink in an ink tank used in the above printing apparatus.

According to still another aspect of the present invention, the foregoing object is attained by providing a residual ink detection method in a printer which scans an detachable printhead integrating an ink tank, discharges ink from the printhead, and performs printing on a printing medium, comprising: a memory step of storing a predetermined threshold value for determination on an amount of residual ink in the ink tank; a detection step of detecting the amount of residual ink in the ink tank; a smoothing step of smoothing variation in the result of detection at the detection step; a comparison step of comparing the detection result smoothed at the smoothing step with the predetermined threshold value; and a first determination step of determining whether or not the ink remains in the ink tank, in accordance with the result of comparison at the comparison step.

In accordance with the present invention as described above, upon performing printing by discharging ink on a printing medium while moving a printhead, the detection means detects the amount of residual ink in a detachable ink tank that holds ink and that moves integrally with the printhead. Then the smoothing means smoothes the result of detection by the detection means. The comparison means compares the smoothed detection result with a predetermined threshold level for discrimination of the amount of residual ink in the ink tank. In accordance with the comparison result, the first determination means determines whether the residual ink remains in the ink tank.

The present invention is particularly advantageous since it eliminates the fluctuation of detection result due to, e.g., ripples of the ink surface caused by the movement of the printhead or mixture of noise, thus attains detection of the amount of residual ink with higher precision.

Further, in this construction, the threshold value for discriminating the amount of residual ink is updated based on the detection result, obtained from the detection of the amount of residual ink upon ink tank attachment/detachment or every residual-ink detection. This enables residual-ink detection automatically reflecting the status of a new ink tank or a current ink tank.

Further, the result of detection of the amount of residual ink can be utilized in discrimination of the apparatus status, e.g., incomplete attachment of ink tank or unexpected exposure to external light. This eliminates a sensor for the above discrimination and the like, thus contributing to reduce the number of parts used in the overall apparatus and costs.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Structure of Apparatus (FIGS. 1 to 5)>

Mechanical Structure

Figure 1:
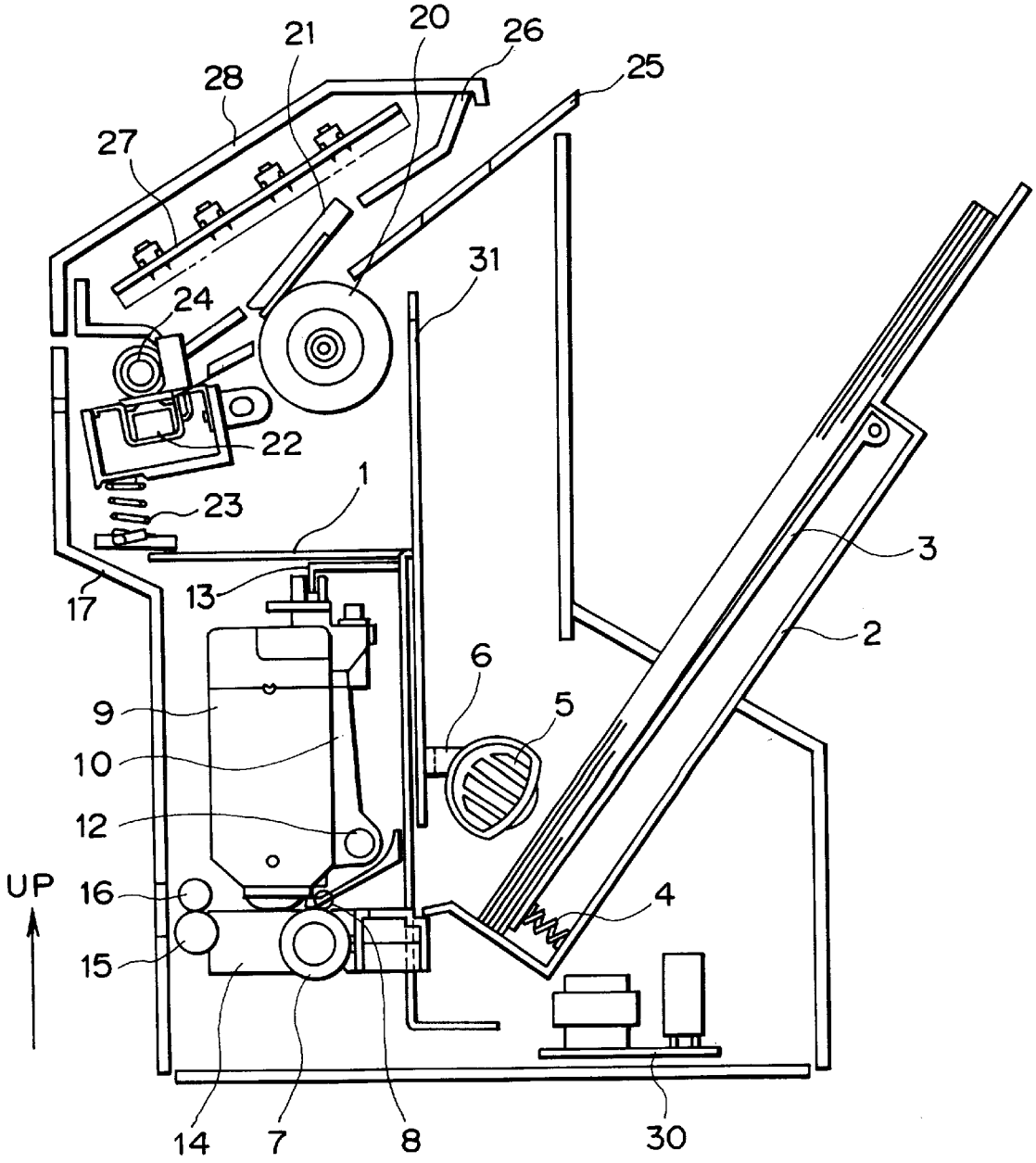
FIG. 1 is a cross-sectional view showing the mechanical structure of a facsimile apparatus having a printing unit in accordance with an ink-jet printing method, as a typical embodiment of the present invention.

FIG. 1 is a cross-sectional view showing the mechanical structure of a facsimile apparatus having a printing unit in accordance with an ink-jet printing method, as a typical embodiment of the present invention.

First, the construction of the printing unit of the facsimile apparatus will be described.

In FIG. 1, reference numeral 1 denotes a frame (main frame) as a main constituent of the overall apparatus; 2, an ASF (Auto Sheet Feeder) chassis attached to the frame 1, as a cassette of the ASF for holding plural print sheets and feeding the sheets into the printing unit one by one; 3, an intermediate board rotatably attached to the ASF chassis 2; and 4, a spring for biasing the intermediate board 3 upward in a clockwise direction; 5, a print-sheet separation roller which rotates in the clockwise direction by a mechanically driven unit (not shown); and 6, a photo-interruptive type sensor (hereinafter referred to as "roller-position sensor") for detecting a home position of the print-sheet separation roller 5.

It should be noted that the position of the intermediate board 3 in FIG. 1 corresponds to a standby status where it is pivoted in a counterclockwise direction and stopped by a cam (not shown) provided in the mechanically driven unit (not shown), controlling the movement of the intermediate board 3. When the cam is disengaged, the intermediate board 3 rotates in the clockwise direction, and the intermediate board 3 or the print sheet comes into contact with the outer circumferential portion of the print-sheet separation roller 5. Further, the movement of the intermediate board 3 and the position of an aspherical portion of the print-sheet separation roller 5 are in synchronization with each other.

Numeral 7 denotes a print-sheet convey roller which rotates in the counterclockwise direction by the mechanically driven unit (not shown); and 8, a print-sheet convey rod, provided around the print-sheet convey roller 7, in contact with the print-sheet convey roller 7 by a spring (not shown). The print-sheet convey roller 7 and the print-sheet convey rod 8 clamp the print sheet at a position where they are in contact with each other, and convey the print sheet in the leftward direction in FIG. 1 (hereinafter referred to as "subscanning direction"). Numeral 9 denotes an exchangeable (disposable) type ink cartridge integrating a printhead in accordance with the ink-jet printing method and an ink tank as an ink reservoir; and 10, a carriage to which the ink cartridge 9 is detachably attached.

The printing surface of the ink cartridge 9 is at the bottom part of the ink cartridge 9 in FIG. 1, and it has a plurality of nozzles arrayed in a transverse direction, forming the printing-surface. Upon printing, the ink cartridge 9 is moved in an orthogonal direction to the nozzle arrangement direction (i.e., vertical direction with respect to the figure; hereinafter referred to as "main-scanning direction"). Printing on a printing area for printing width is performed by selectively discharging ink from those nozzles. Thereafter, the print sheet is shifted by the printing width in the subscanning direction. Thus printing is made on the print sheet by repeating this printing operation (This printing method is called a "multiscan method"). A residual-ink detection sensor (ink sensor), comprising a reflection type photosensor, is attached to the carriage 10, for detecting the amount of residual ink in the ink cartridge 9. The detection direction of the ink sensor is approximately the same as the main-scanning direction of the ink cartridge 9. Since the ink sensor is attached to the carriage 10, the ink sensor moves with the ink cartridge 9 as the carriage 10 moves. Note that this movement will be described in detail later.

Numerals 12 and 13 denotes guide rails for assisting the reciprocating movement of the carriage 10 in the main-scanning direction. The carriage 10 is attached to these guide rails 12 and 13 movably in the main-scanning direction, and is reciprocated by the mechanically driven unit (not shown). Numeral 14 denotes a platen, opposing to the printhead, for holding the print sheet to face the printhead, and maintaining the distance from the print sheet to the printhead at the printing position. Numeral 15 denotes a paper discharge roller; and 16, a paper discharge rod. The paper discharge rod 16 is biased by a press member (not shown) against the paper discharge roller 15. The paper discharge roller 15 and the paper discharge rod 16 hold discharge the print sheet while holding the print sheet at a contact portion between them. Numeral 17 denotes a cover (print-sheet cover) which opens downward with a bottom portion of the apparatus as its pivotal axis.

Next, the construction of a reading unit of the facsimile apparatus will be described.

Numeral 20 denotes a reading separation roller which rotates in the counterclockwise direction by the mechanically driven unit (not shown) and conveys each of plurality of originals in the leftward direction in FIG. 1 one by one; 21, a separation piece, comprising of high-friction material such as rubber, biased by a press member (not shown) against the reading separation roller 20, for separating the plurality of originals one by one; 22, a contact type line image sensor (hereinafter referred to as "image sensor") which reads images on the originals and converts the read image information into electric signals; 23, a CS spring; and 24, a white CS roller which rotates in the clockwise direction by the mechanically driven unit (not shown). The CS spring 23 presses the image sensor 22 against the CS roller 24. The CS roller 24 brings the original into tight contact with the entire reading surface of the image sensor 22, conveys the original in the leftward direction in FIG. 1, and functions as a background in original reading.

Numeral 25 denotes an original guide, fixed to the frame 1 that supports (as a part of the apparatus body the reading unit and an operation panel (described later), for guiding the back surface of the original; 26, an original guide, fixed to the original guide 25, for guiding the front surface of the original; 27, an operation circuit board having operation switches; and 28, the operation panel, to which the operation circuit board 27 is fixed. The operation panel 28 itself is fixed to the original guide 25.

Numeral 30 denotes a power unit comprising a power transformer, a capacitor and the like; and 31, an electric control board, attached to the frame 1, for controlling the operation of the overall apparatus. The electric control board 31 is connected with all wires and cables from electric devices, divided into the respective parts, components (the image sensor 22, the operation circuit board 27, the power unit 30, the ink cartridge 9, respective drive motors (not shown), the roller position sensor 6, and respective sensors (not shown)). Note that various sensors including a sensor for detecting presence/absence of print sheet, which are not described here, are directly integrated onto the electric control board 31 without using wires and cables. Further, all the external interfaces (e.g., a public telephone line network interface, an auxiliary sub-telephone interface, an external sub-telephone interface, and a personal-computer interface such as a centronics interface) are connected to the electric control board 31.

Figure 2:
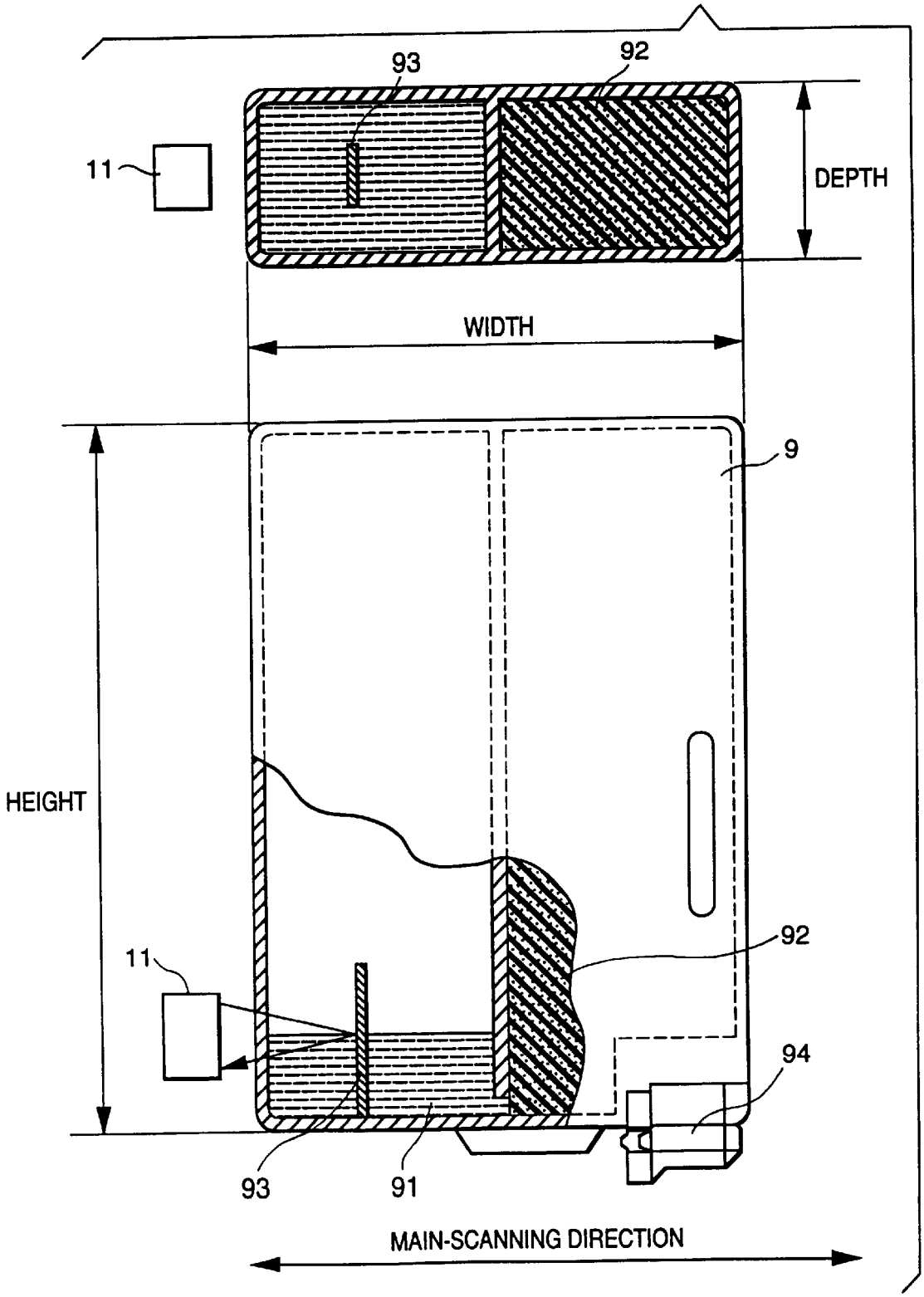
FIG. 2 is a partial-cutaway view showing the detailed construction of an ink cartridge 9.

FIG. 2 is a partial-cutaway view showing the detailed construction of the ink cartridge 9. In FIG. 2, numeral 11 denotes a reflection type photosensor (hereinafter referred to as "photosensor"); 91, ink; 92, a sponge; 93, a reflection board for reflecting light from the photosensor 11; and 94, a printhead. FIG. 2 especially shows status where the carriage 10 and the ink cartridge 9 to be mounted on the carriage 10 stand still. Accordingly, the surface of the ink 91 is smooth without ripples.

It is apparent from FIG. 2, the reflection board 93 is provided around the bottom of the ink cartridge, at a position near a ink-cartridge side wall, around which the photosensor 11 for the reflection board 93 is provided. This arrangement of the reflection board 93 around the photosensor 11 is intended to enhance the intensity of reflected light to be received by the photo sensor 11, and improve S/N ratio in residual-ink detection. The interval (detection gap) between ink-cartridge side wall on the photosensor 11 side and the reflection board 93 is set, in consideration of the ink-surface tension and the water repellent relation among the side wall, the ink, and the reflection board, so as not to gather ink between the photosensor 11 and the side wall. This interval should preferably be 2 to 4 mm for more accurate residual-ink detection.

Further, right space and left space with respect to the reflection board 93 provided as above are not separate reservoirs but are connected. In other words, as shown in FIG. 2, the depth of the reflection board 93 does not occupy the full depth of the ink cartridge 9 but occupies a part of the depth of the ink cartridge 9. That is, the reflection board 93 is positioned around the central portion of the depth. This arrangement renders the same change to the ink surface between the reflection board 93 and the photosensor 11 as that to the ink surface of the ink within other parts of the ink cartridge. In addition to this arrangement, a hole may be provided around the bottom of the reflection board 93 to obtain the same level of the ink surface, on the both sides, around the reflection board 93.

When the ink cartridge 9 is filled up with the ink 91, the photosensor 11 hardly detects light reflected from the reflection board 93 since the light is interrupted by the ink 91. At this time, the output current from the photosensor 11 is approximately zero. On the other hand, when the ink cartridge has little or no ink 91, the photosensor 11 detects the light reflected from the reflection board 93, and as a result, outputs current corresponding to the reflection light intensity.

Electrical Construction

Figure 3:
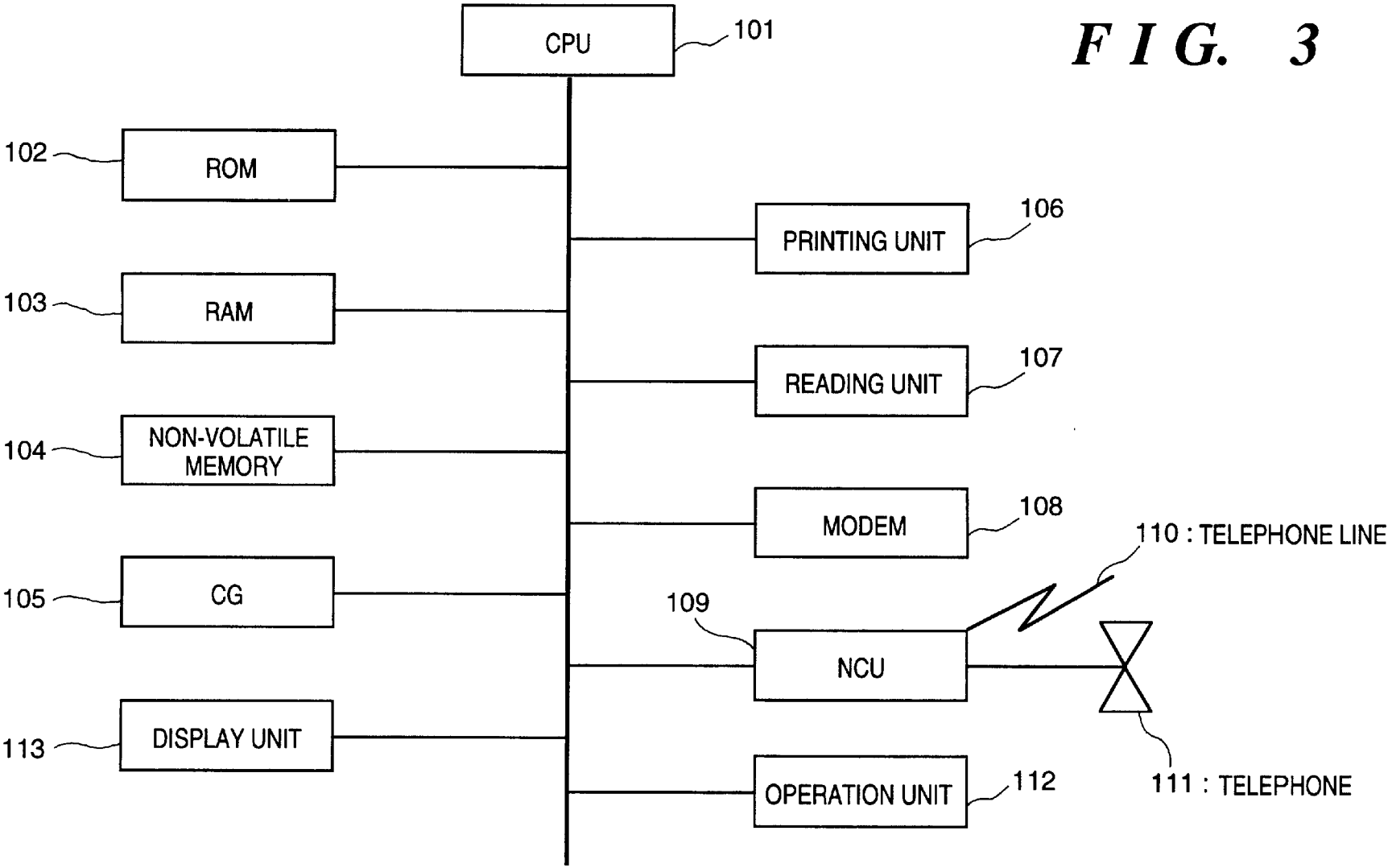
FIG. 3 is a block diagram showing the electrical construction of the facsimile apparatus in FIG. 1.

FIG. 3 is a block diagram showing the electrical construction of the facsimile apparatus in FIG. 1. In FIG. 3, numeral 101 denotes a CPU comprising a microprocessor or the like; 102, a ROM for storing control programs and processing programs executed by the CPU 101; 103, a RAM used as a storage area for storing image data for facsimile transmission/reception or read image data for copying processing and as a work area for the CPU 101 to execute the control programs and the processing programs; 104, a non-volatile memory comprising of a DRAM or an SRAM having a backup power source, or an EEPROM, for storing information even not supplied with power from the power unit 30.

Numeral 105 denotes a character generator (CG) which generates character patterns in accordance with character codes, represented based on a code system such as JIS codes or ASCII codes; 106, the printing unit having the construction as described in FIG. 1; 107, the reading unit having the construction as described in FIG. 1; 108, a MODEM; 109, a network control unit (NCU); 110, a telephone line; 111, a telephone; 112, an operation unit having a part of the operation panel 28 of the operation circuit board 27, as described in FIG. 1; and 113, a display unit having an LCD, LEDs and the like, with a part of the operation panel 28 of the operation circuit board 27, as described in FIG. 1.

The CPU 101 controls the ROM 102, the RAM 103, the non-volatile memory 104, the CG 105, the printing unit 106, the reading unit 107, the MODEM 108, the NCU 109, the operation unit 112, and the display unit 113.

The RAM 103 is used for storing binary image data read by the reading unit 107 or binary image data to be printed by the printing unit 106. Also, the RAM 103 is used for storing encoded image data to be modulated by the MODEM 108 and outputted onto the telephone line 110 via the NCU 109, and encoded image data obtained from demodulating, via the NCU 109 and the MODEM 108, an analog image signal received via the telephone line 110. The non-volatile memory 104 is used for storing data to be held regardless of presence/absence of power supply (e.g., abbreviated telephone numbers). The CG 105 generates character pattern data corresponding to input codes in accordance with necessity, under the control of the CPU 101.

The electric circuit of the printing unit 106, comprising a DMA controller, the ink-jet printhead, a CMOS logic IC and the like, reads the image data stored in the RAM 103, and print-outputs the data. On the other hand, the electric circuit of the reading unit 107, comprising a DMA controller, an image processing IC, an image sensor, a CMOS logic IC and the like, binarizes the image data read from the image sensor 22 and sequentially outputs the binary data to the RAM 103, under the control of the CPU 101. Note that the status of an original which is set with respect to the reading unit 107 can be detected by an original detection unit (not shown) using a photosensor provided on an original convey path.

The MODEM 108, comprising a G3/G2 MODEM, a clock generator connected to the MODEM and the like, modulates encoded transmission data stored in the RAM 103 and outputs the data onto the telephone line 110 via the NCU 109, otherwise, inputs, via the NCU 109, an analog image signal received via the telephone line 110, demodulates the input signal to obtain encoded received data, and stores the data into the RAM 103, under the control of the CPU 101. The NCU 109 switches the connection of the telephone line 110 to the MODEM 108 or to the telephone 111, under the control of the CPU 101. The NCU 109 has a detection circuit for detecting a calling signal (CI). When the calling signal is detected, the NCU 109 sends an incoming-call signal to the CPU 101.

The telephone 111 is integrated with the facsimile apparatus main body, comprising a handset, a speech network, a dialer, ten-keys, single-touch keys and the like. The operation unit 112 comprises a start key to start image transmission/reception, a resolution selection key to switch resolution of the facsimile image upon transmission/reception to fine mode, standard mode and the like, a mode selection key to designate operation mode upon automatic reception and the like, ten-keys and single-touch keys for dialing, and the like. The display unit 113 comprises an LCD module including a seven-segmented LCD for time display, an iconic LCD for displaying icons representing various modes, a matrix LCD for displaying 5×7 dots (one character)×one line, LEDs, and the like.

Next, the electrical construction of a residua-ink detection unit provided at the printing unit 106 will be described.

Figure 4:
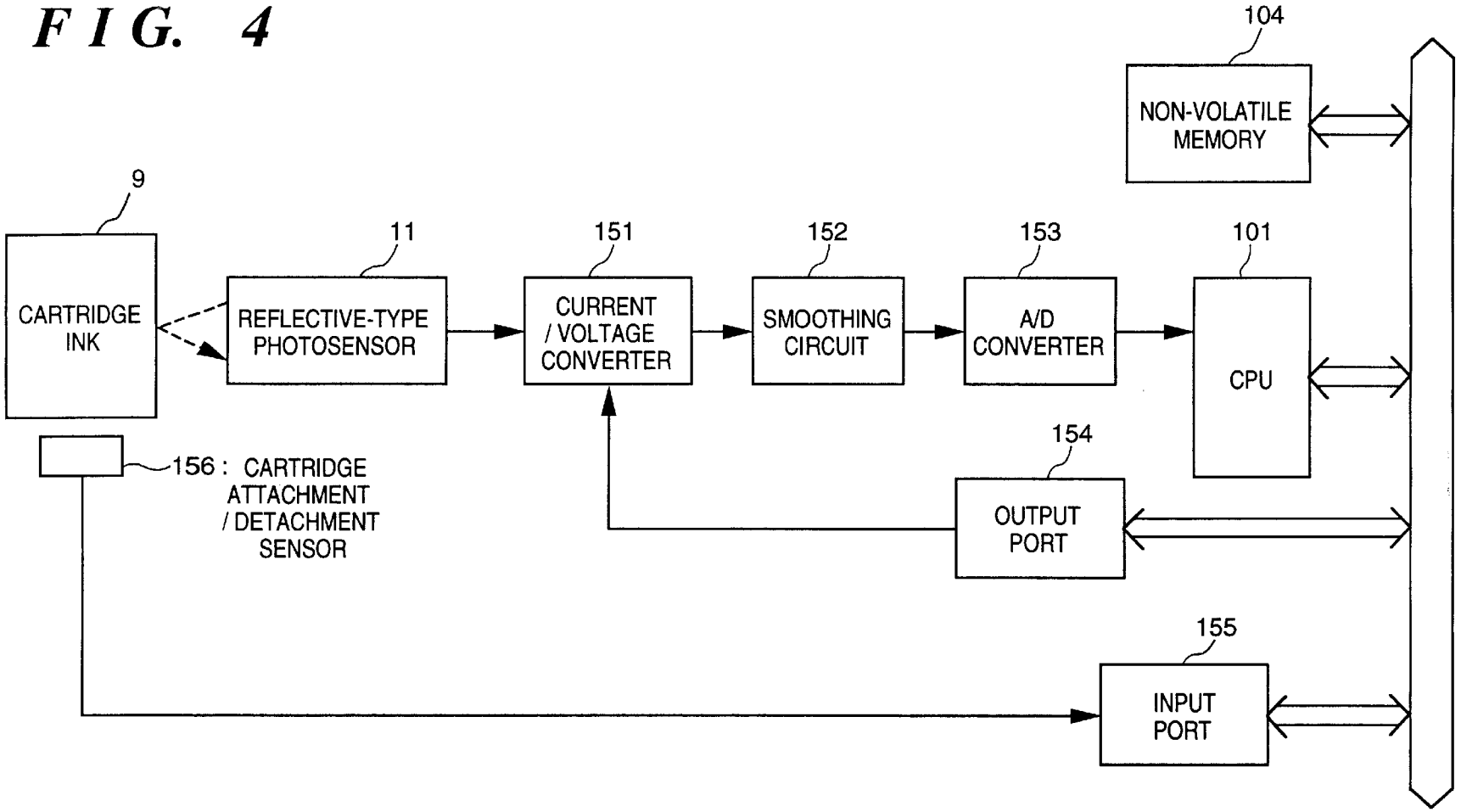
FIG. 4 is a block diagram showing the electrical construction of a residual-ink detection unit.

FIG. 4 is a block diagram showing the electrical construction of the residual-ink detection unit.

In FIG. 4, numeral 151 denotes a current/voltage converter for converting current into a voltage corresponding to the intensity of the output current from the photosensor 11; 152, a smoothing circuit which eliminates noise caused by the movement of the ink cartridge 9, and minimizes variation in output voltage due to ripples of the ink surface also caused by the movement of the ink cartridge 9; 153, an A/D converter; 154, an output port for supplying a switching signal (described later) to the current/voltage converter 151 in accordance with a control signal from the CPU 101; 155, an input port to input outputs from various sensors and output the signals to the CPU 101; and 156, a cartridge attachment/detachment sensor for detecting whether the ink cartridge 9 is attached to the carriage 10 or not. Note that the current/voltage converter 151 can vary the ratio of current/voltage conversion by the switching signal from an external device (CPU 101), and the output from the A/D converter 153 is inputted into the CPU 101.

Figure 5:
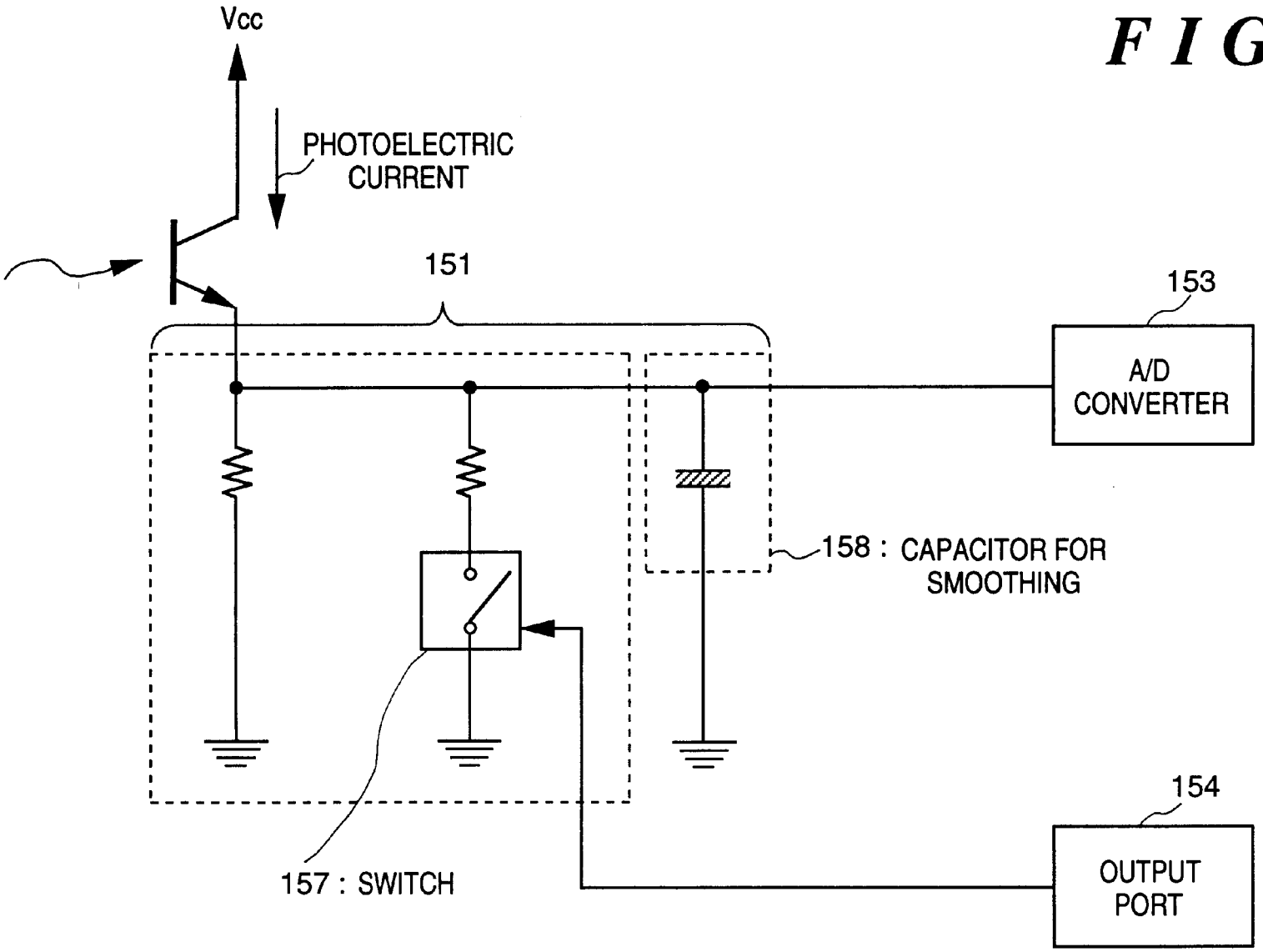
FIG. 5 is a block diagram showing the detailed construction of a current/voltage converter 151.

FIG. 5 is a block diagram showing the detailed construction of the current/voltage converter 151. As apparent from FIG. 5, when the ink cartridge 9 has sufficient ink, the output from the photosensor 11 is at a low level, consequently, a low-level signal is inputted into the A/D converter 153. On the other hand, when the ink cartridge 9 has little or no ink, the output from the photosensor 11 is at a high level, consequently, a high-level signal is inputted into the A/D converter 153. Further, a switch 157 is opened/closed (ON/OFF) in accordance with an ON/OFF signal from the output port 154. Accordingly, the value (VI) of the output signal from the A/D converter 153 is small as the amount of residual ink is large, while the value is large as the amount of residual ink is small.

When the switch 157 is closed (ON), as the resistance is connected in parallel, the input voltage to the A/D converter 153 is smaller than that when the switch 157 is opened (OFF). In this manner, the input voltage level to the A/D converter 153 can be adjusted.

In FIG. 5, numeral 158 denotes a capacitor for smoothing. The capacitor 158 functions to smooth the signal with the above resistance element.

The variation of the value (VI) of the output signal from the A/D converter 153 corresponding to a variation of the amount of residual ink in the ink cartridge will be considered in detail. As described above, when the ink cartridge 9 has sufficient ink, the value VI is small. When there is no or little ink in the ink cartridge 9, the value VI is large. In other words, when the reflection board 93 is completely immersed in the ink, the value VI always stays small. However, when the amount of residual ink becomes lesser and lesser, and a part of reflection board 93 appears from the ink surface, as indicated in FIG. 2, the photosensor 11 somewhat receives the reflected light. As a consequence, the value VI becomes larger. As the consumption of residual ink is continued, the value VI becomes larger and larger. Finally, the entire field of view of the photosensor 11 receives the light reflected from all or most part of the reflection board 93, when the residual ink completely or almost goes off. At that point, the value VI comes to a medium value.

Next, the residual-ink detection of the apparatus using the residual-ink detection unit having the above construction will be described with reference to the flowchart of FIG. 6. Note that the apparatus has two operation modes related to the residual-ink detection, "normal mode" for user's usual operation and "maintenance mode" for determination on presence of ink upon shipping from a factory or maintenance of the apparatus. The "maintenance mode" is activated at the final production process at the factory, otherwise, it is activated by a maintenance engineer in accordance with a particular procedure at the installation site.

First, at step S1, whether the operation mode is the "normal mode" or the "maintenance mode" is examined. If the mode is the "normal mode", the process proceeds to step S3, while if the mode is the "maintenance mode", the process proceeds to step S2.

At step S2, for residual-ink detection in the normal mode, a threshold level (TH) of the amount of residual ink for determining that "ink remains (there is ink)" is stored into the non-volatile memory 104. More specifically, a cartridge, containing ink of a reference amount to be determined that the ink remains, is attached to the apparatus, then the residual-ink detection unit is operated, and a threshold level (TH) based on the actual detection result is stored into the non-volatile memory 104. This setting may be made by packaging an EEPROM, at which the threshold level (TH) is set, into the apparatus, otherwise, a maintenance engineer may input an appropriate numerical value using the operation unit 112 and the display unit 113. At this time, it is set such that the level of the output from the output port 154 is optimized. After the setting of the threshold level, the process ends.

On the other hand, if the operation mode is the "normal mode", an output value (VI) from the A/D converter 153, obtained based on the output current from the photosensor 11, is read at step S3. At this time, the level of the input voltage to the A/D converter 153 is adjusted in accordance with an ON/OFF signal from the output port 154. Next, at step S4, the amount of residual ink (EVI) equivalent to the read value (VI) is compared with the threshold level (TH) set at the non-volatile memory 104. If $EVI<4\times TH$ holds, the process proceeds to step S5, at which it is determined that the ink remains (there is ink), while if $EVI\geq 4\times TH$ holds, the process proceeds to step S6, at which it is determined that the ink is exhausted (there is no ink).

The determination reference, 4×TH is used with the intention to immediately obtain a value quadruple of comparison object data by 2-bit shifting in accordance with a shift instruction from the CPU 101. Further, the value of the EVI becomes greater as the amount of residual ink becomes less as described above. Thus, the EVI value becomes greater in the progress of the printing operation particularly after the reflection board 93 appears from the ink surface. That is, the EVI value is small when the ink cartridge is new and is filled up with the ink to satisfy the condition EVI<4×TH, while the EVI value is large when the amount of ink consumption has been increased, to satisfy the condition EVI≳4×TH.

As the determination on the existence/absence of ink is made in this manner, print control is performed in accordance with the determination result. For example, if it is determined that there is no residual ink in the ink cartridge, a warning message is displayed on the display unit 113, otherwise, the amount of ink consumption is saved by discharging ink from only even/odd numbered nozzles.

According to the present embodiment, residual-ink detection is performed in accordance with a threshold level set/adjusted upon shipment from a factory or maintenance. Since the threshold level is set in consideration of variations such as variation of photosensor output, secular change, installation environment, and mechanical tolerance, once the threshold level is set, accurate residual-ink detection can be performed, reflecting the characteristic of the apparatus, without adjustment of the threshold level by a user of the apparatus.

Since the information obtained from the photosensor is outputted through the smoothing circuit 152, even though the ink cartridge 9 moves at a high speed, the influence of noise and ripples of the ink surface caused by the movement can be suppressed, thus residual-ink detection can be performed with higher precision.

Further, upon shipment from the factory, since only the threshold level regarding determination "ink remains" is set in the non-volatile memory, the number of settings regarding the threshold level is only once. This simplifies handling of the product upon shipment or a maintenance engineer's adjustment at adjustment/maintenance time.

Figure 7:
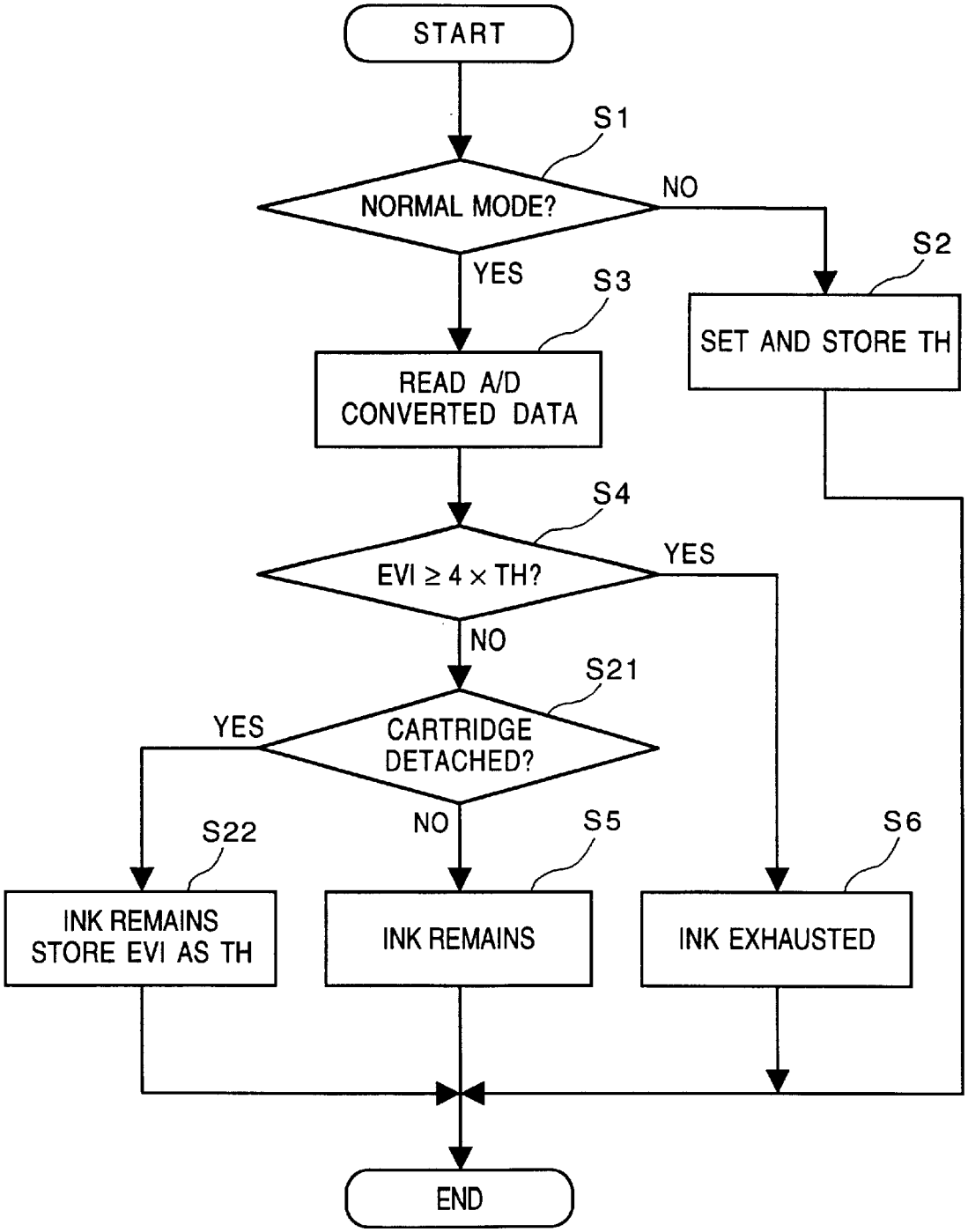
FIG. 7 is a flowchart showing another example of the residual-ink amount detection processing.

Furthermore, in the present embodiment, though exchange of the ink cartridge during operation of the apparatus is not mentioned, it may be arranged such that as shown in the flowchart of FIG. 7, necessity for exchange of ink cartridge is determined, and the threshold level set in the non-volatile memory is automatically re-set, in accordance with the determination.

That is, after the determination at step S4, at step S21, whether or not the ink cartridge 9 has been detached is determined, based on the result of detection by the cartridge attachment/detachment sensor 156. If NO, i.e., it is determined that the ink cartridge 9 has not been detached, the process proceeds to step S5, while if YES, i.e., it is determined that the ink cartridge 9 has been detached, the process proceeds to step S22. At step S22, it is determined that the ink exists, and value (EVI) indicating the amount of residual ink obtained at that time is rewritten as a new threshold level (TH) into the non-volatile memory 104, where the previous threshold level is replaced with the new threshold level.

Figure 6:
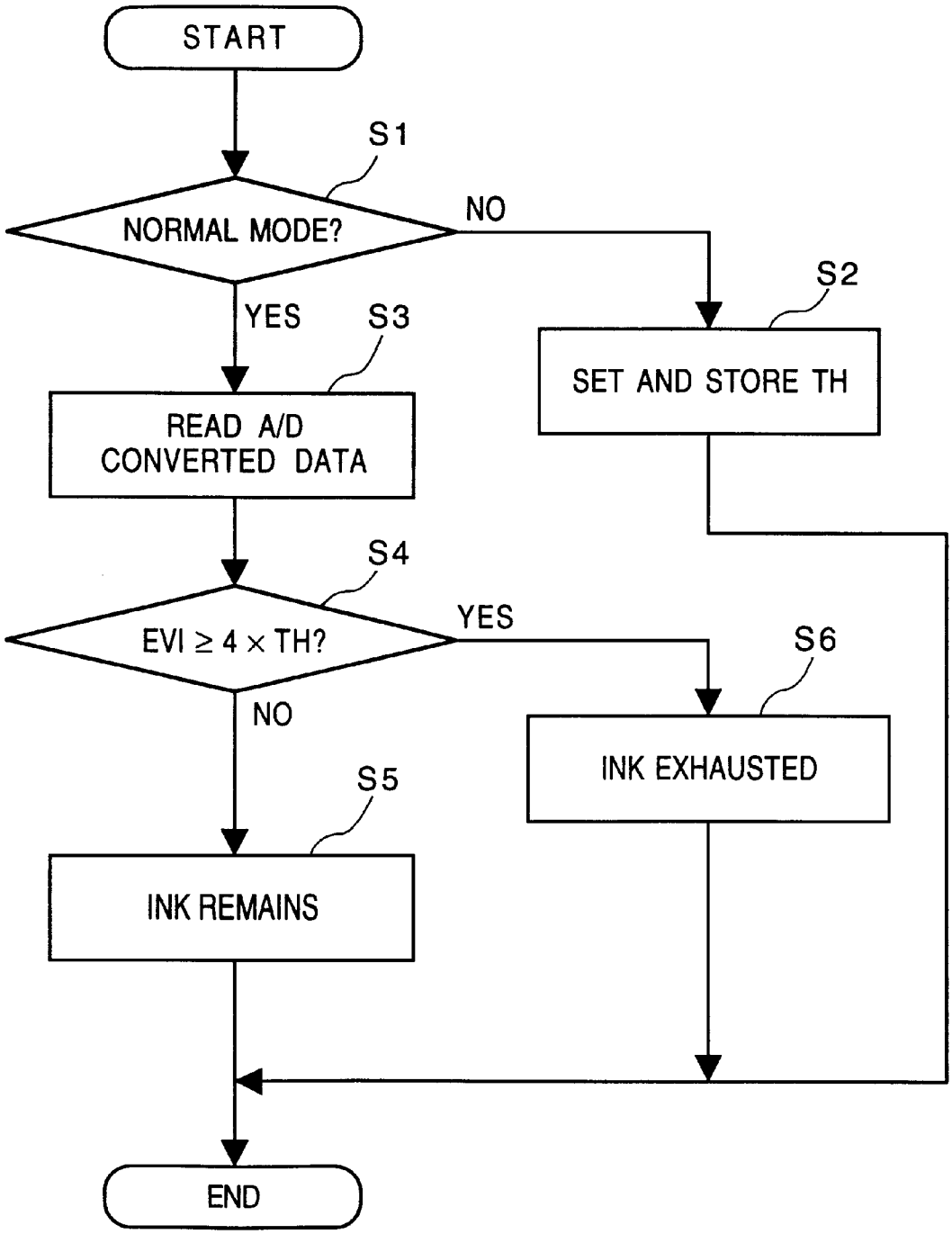
FIG. 6 is a flowchart showing residual-ink amount detection processing.

Note that in FIG. 7, steps corresponding to those in FIG. 6 have the same reference numerals, and the explanation of those steps will be omitted.

As described above, updating the threshold level for ink existence/absence determination every time the ink cartridge has been exchanged enables residual-ink detection with higher precision, in consideration of the influence due to secular change of the apparatus or mechanical tolerance of the ink cartridge itself.

Another Embodiment

In the above embodiment, upon shipment from a factory, only the threshold level of the amount of residual ink used for determination on whether or not "the ink remains (there is ink)" is set in the non-volatile memory 104. However, as will be described with reference to the flowchart of FIG. 8, this embodiment sets a threshold level of the amount of residual ink for determination on whether or not "the ink is exhausted (there is no ink)", as well as the threshold level for determination of the existence of the ink, and performs residual-ink detection in accordance with these two threshold levels.

Figure 8:
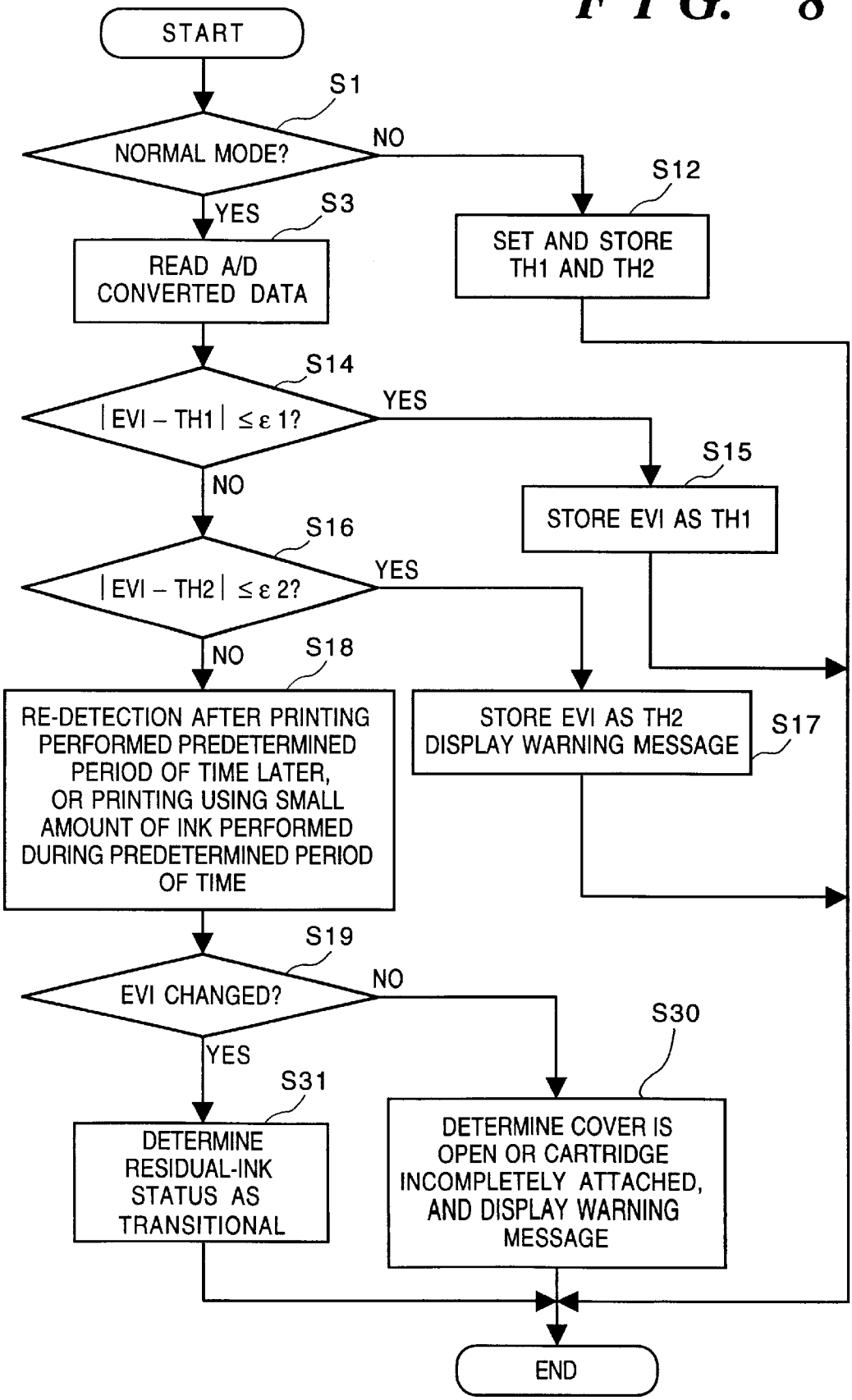
FIG. 8 is a flowchart showing still another example of the residual-ink amount detection processing.

Note that in the flowchart of FIG. 8, steps corresponding to those in FIG. 6 have the same reference numerals, the explanation of those steps will be omitted, and only steps characteristic of this embodiment will be described below.

At step S1, if it is determined that the operation mode is the "maintenance mode", the process proceeds to step S12. At this step, two ink cartridges for the above different determinations are actually attached alternatively, as each ink cartridge has been attached, and the residual-ink detection unit is operated. More specifically, one ink cartridge contains ink of a predetermined amount as a reference for determining that the ink remains. The residual-ink detection unit obtains a threshold level while this cartridge has been attached, as a threshold TH1 (indicating that the ink remains). The other ink cartridge contains ink of a predetermined amount as a reference for determining that the ink is exhausted. The residual-ink detection unit obtains a threshold level while this cartridge has been attached, as a threshold TH2 (indicating that the ink is exhausted). The two threshold levels TH1 and TH2 are stored into the non-volatile memory 104. Further, it is arranged such that the output level from the output port 154 is optimized at this time. Thereafter, the process ends.

If it is determined at step S1 that the operation mode is the "normal mode", the process advances to step S14 through step S3, at which the residual ink amount (EVI) corresponding to a read value (VI) is compared with the threshold level (TH1) stored in the non-volatile memory 104. If $|EVI-TH1|\leq\epsilon1$ holds, it is determined that the ink remains. The process proceeds to step S15, at which the EVI value is stored as a new threshold level TH1 into the non-volatile memory 104, and the process ends. On the other hand, if $|EVI-TH1|>\epsilon1$ holds, it is considered that this result cannot be determined that the ink remains. The process proceeds to step S16, at which the residual-ink amount (EVI) corresponding to the read value (VI) is compared with the threshold level (TH2) set in the non-volatile memory 104.

If $|EVI-TH2|\leq\epsilon2$ holds, it is determined that the ink is exhausted. The process proceeds to step S17, at which the EVI value is stored as a new threshold level TH2 into the non-volatile memory 104, then a warning message indicating the shortage of ink is displayed on the display unit 113, and the process ends. On the other hand, If $|EVI-TH2|>\epsilon2$ holds, it is considered that this result cannot be determined that the ink remains or no ink remains. The process proceeds to step S18, at which, after a retry of a printing operation is performed a predetermined period of time later or another printing operation using a small-amount of ink is performed during the predetermined period of time, data (VI) based on the output from the photosensor 11 is read from the A/D converter 153 again. Then, whether or not there is change in the obtained residual-ink amount (EVI) is examined based on the read value. This re-examination is repeated several times to check the change of the EVI value.

From the EVI value obtained as above, the change is examined at step S19. If it is determined that there is no change in the EVI value, the process proceeds to step S30, at which it is determined that the cover 17 that protects the residual-ink detection unit is opened, causing influence due to external light on the residual-ink detection, otherwise, the ink cartridge 9 has been incompletely attached, causing influence upon the residual-ink detection. Then, an appropriate warning message is displayed on the display unit 113 to notify the user of the determination. On the other hand, if it is determined at step S19 that there is change in the EVI value, the process proceeds to step S31, at which it is determined that this result indicates transitional status from the "ink remains" status to the "ink does not remain" status.

Accordingly, the present embodiment performs determination of the residual-ink amount based on the two threshold levels, which improves precision of the determination. Further, in a case where the determination is still vague even with the two threshold levels, variation of before/after printing operation in the information obtained from the residual-ink detection is considered. Based on the variation, other factors to disturb accurate residual-ink detection, e.g., influence of external light or incomplete attachment of the ink cartridge are considered. Then, the determination is notified to the user with an appropriate warning message. Further, transitional status between the "ink exists" status and the "ink is exhausted" status is discriminated, so that the residual-ink detection can be retried for more accurate detection.

Further, as described above, the influence of external light or the incomplete attachment of the ink cartridge can be detected at the same time of residual-ink detection, additional sensors for detecting these facts can be omitted.

The embodiments described above have exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the print head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the print head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

In addition, an exchangeable chip type print head which can be electrically connected to the apparatus main unit and can receive an ink from the apparatus main unit upon being mounted on the apparatus main unit or a cartridge type print head in which an ink tank is integrally arranged on the print head itself can be applicable to the present invention.

It is preferable to add recovery means for the print head, preliminary auxiliary means, and the like provided as an arrangement of the printer of the present invention since the printing operation can be further stabilized. Examples of such means include, for the print head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated print head or by combining a plurality of print heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus which scans a printhead, discharges ink from the printhead and performs printing on a printing medium, comprising:

a carriage carrying the printhead and an ink tank containing the ink to be discharged from the printhead;

scan means for scanning the carriage;

a detection device detecting whether or not a level of residual ink in the ink tank is equal to or higher than a predetermined level, and outputting a signal having a level that varies in dependence on a detection result;

smoothing means for smoothing the signal outputted by said detection device; and determination means for determining an amount of residual ink in the ink tank, in accordance with the result of smoothing the signal, whose output level is affected by ripples of ink surface according to a scanning by said scanning means, by said smoothing means.

2. The apparatus according to claim 1, further comprising:

memory means for storing a predetermined threshold value used for determining the amount of residual ink in the ink tank; and comparison means for comparing the signal smoothed by said smoothing means with a predetermined threshold value, wherein said determination means determines the amount of residual ink in the ink tank, based on comparison result by said comparison means.

3. The apparatus according to claim 2, wherein if a numerical value, representing the amount of residual-ink detected by said detection means, is equal to the threshold value, multiplied by n-th power of two ($X \cdot 2^n$) or greater, said first determination means determines that the ink is exhausted.

4. The apparatus according to claim 3, wherein n=2.

5. The apparatus according to claim 3, further comprising:

discrimination means for discriminating whether or not the ink tank has been detached; and first exchange means for, if said second determination means determines that the ink tank has been detached, exchanging the predetermined threshold value stored in said memory means with information based on an amount of residual ink obtained immediately after exchange of the ink tank.

6. The apparatus according to claim 2, further comprising initial setting means for setting the predetermined threshold value.

7. The apparatus according to claim 6, wherein said initial setting means can store a plurality of threshold values as the predetermined threshold value into said memory means, and wherein among the plurality of threshold values, a threshold value is used as a first threshold value for determining whether or not the ink remains in the ink tank, and another threshold value is used as a second threshold value for determining whether or not the ink in the ink tank is exhausted.

8. The apparatus according to claim 7, wherein said comparison means compares the result of detection by said detection means with the first and second threshold values.

9. The apparatus according to claim 8, further comprising:

second exchange means for, if it is determined in accordance with the result of comparison by said comparison means that the ink remains in the ink tank, exchanging the first threshold value stored in said memory means with information based on the amount of residual ink detected by said detection means; and third exchange means for, if it is determined in accordance with the result of comparison by said comparison means that the ink in the ink tank is exhausted, exchanging the second threshold value stored in said memory means with information based on the amount of residual ink detected by said detection means.

10. The apparatus according to claim 9, further comprising:

first display means for, if it is determined in accordance with the result of comparison by said comparison means that the ink in the ink tank is exhausted, displaying a warning message.

11. The apparatus according to claim 9, further comprising:

detection control means for, if it cannot be determined in accordance with the result of comparison by said comparison means that the ink remains in the ink tank or the ink in the ink tank is exhausted, controlling said detection means to detect an amount of residual ink again after a retry of a printing operation is performed a predetermined period of time later or another printing operation using a small amount of ink is performed during the predetermined period of time.

12. The apparatus according to claim 11, wherein said detection means includes a reflection board for reflecting light from a reflective type photosensor and a light-emitting device, wherein said reflective type photosensor is comprised by the light-emitting device and a photoreceptor.

13. The apparatus according to claim 12, further comprising:

interpretation means for interpreting whether or not there is time variation between the result of previous and new detection by said detection means; and third determination means for determining incomplete attachment of the ink tank or an unexpected stream of external light of external light on the photoreceptor, based on the result of interpretation by said interpretation means.

14. The apparatus according to claim 13, further comprising second display means for displaying a warning message based on the result of determination by said third determination means.

15. The apparatus according to claim 13, wherein said detection control means controls said detection means, in accordance with the result of interpretation by said interpretation means, to detect an amount of residual ink again after a retry of a printing operation is performed a predetermined period of time later or another printing operation using a small amount of ink is performed during the predetermined period of time.

16. The apparatus according to claim 2, wherein said memory means is a non-volatile memory.

17. The printer according to claim 1, wherein the printhead includes discharging means for discharging ink by generating pressure in the ink, and a nozzle.

18. The printer according to claim 17, wherein said discharging means is thermal-energy transducers for generating thermal energy to be supplied to the ink, and the printhead generates a bubble in the ink by the thermal energy and discharges the ink from the nozzle by the pressure caused by the bubble.

19. A facsimile apparatus using the apparatus claimed in claim 1.

20. The apparatus according to claim 2, wherein said determination means determines whether or not the amount of residual ink in the ink tank is equal to or more than a predetermined amount.

21. The apparatus according to claim 1, wherein the ink tank is detachable from said carriage, and attachable to said carriage.

22. The apparatus according to claim 21, wherein said determination means further determines whether the ink tank is attached to said carriage or detached from said carriage.

23. The apparatus according to claim 1, wherein at least one of walls constituting the ink tank is translucent, a reflector for reflecting light coming through the translucent wall is provided within the ink tank, said detecting device includes:

a light-emitting device emitting light; and a photoreceptor outputting a signal depending on an amount of received light, and the outputted signal varies according to the reflected light by the reflector.

24. The apparatus according to claim 23, wherein the reflector is provided around the bottom of the ink tank.

25. The apparatus according to claim 24, wherein the reflector is provided close to the translucent wall, and a level of ink surface between the reflector and the translucent wall varies according to the amount of residual ink in the ink tank.

26. The apparatus according to claim 23, wherein the reflector is provided close to the translucent wall, and a level of ink surface between the reflector and the translucent wall varies according to the amount of residual ink in the ink tank.

27. The apparatus according to claim 24, wherein said detection device outputs a signal having different level, depending on whether or not the level of ink surface between the reflector and the translucent wall is equal to or higher than the predetermined level.

28. A residual ink detection method in a printer which uses a carriage carrying a printhead discharging ink and an ink tank containing ink to be discharged from the printhead, and performs printing on a printing medium by scanning the carriage, comprising the steps of:

detecting whether or not a level of residual ink in the ink tank is equal to or higher than a predetermined level, and outputting a signal having a level that varies in dependence on a detection result;

smoothing the signal outputted at said detecting step; and determining an amount of residual ink in the ink tank, in accordance with the result of smoothing the signal, whose output level is affected by ripples of ink surface according to the carriage scan, at said smoothing step.

29. The method according to claim 28, wherein said determining step includes the steps of:

comparing the signal smoothed at said smoothing step with a predetermined threshold value; and determining the amount of residual ink in the ink tank, based on the comparison result.

30. The method according to claim 29, wherein the predetermined threshold value is stored in a memory.

31. The method according to claim 30, wherein the ink tank is detachable from said carriage, and attachable to said carriage.

32. The method according to claim 31, further comprising the steps of:

discriminating whether or not the ink tank has been detached; and exchanging the predetermined threshold value stored in a memory with an amount of residual ink obtained immediately after exchange of the ink tank.

33. The method according to claim 28, wherein at least one of walls constituting the ink tank is translucent, a reflector for reflecting light coming through the translucent wall is provided within the ink tank, said detecting step uses a light-emitting device emitting light, and a photoreceptor outputting a signal depending on an amount of received light, and outputs a signal which varies according to the reflected light by the reflector.

* * * * *

UNITED STATES PATENT AND TRADEMARK OFFICE

CERTIFICATE OF CORRECTION

PATENT NO. : 5,900,888

DATED : May 4, 1999

INVENTOR : YUJI KUROSAWA

It is certified that error appears in the above-identified patent and that said Letters Patent is hereby corrected as shown below:

References Cited

FOREIGN PATENT DOCUMENTS

"2102061 4/1990 Japan" should read
--2-102061 4/1990 Japan--.

COLUMN 1

Line 20, "carridge" should read --carriage--.

COLUMN 2

Line 11, "an" should read --a--.

Line 41, "thus" should read --and thus--.

UNITED STATES PATENT AND TRADEMARK OFFICE

CERTIFICATE OF CORRECTION

PATENT NO. : 5,900,888

DATED : May 4, 1999

INVENTOR : YUJI KUROSAWA

It is certified that error appears in the above-identified patent and that said Letters Patent is hereby corrected as shown below:

COLUMN 3

Line 27, "5)>" should read --5)--.

COLUMN 4

Line 20, "(This" should read --(this--.

Line 30, "denotes" should read --denote--.

Line 42, delete "hold".

Line 52, "each of plurality" should read --each of a plurality--.

Line 54, "comprising" should read --comprised--.

UNITED STATES PATENT AND TRADEMARK OFFICE

CERTIFICATE OF CORRECTION

PATENT NO. : 5,900,888

DATED : May 4, 1999

INVENTOR : YUJI KUROSAWA

It is certified that error appears in the above-identified patent and that said Letters Patent is hereby corrected as shown below:

COLUMN 5

Line 2, "body" should read --body)--.

Line 32, "status" should read --the status--.

Line 36, "It" should read --As--.

Line 38, "near a" should read --near an--.

Line 42, "photo sensor" should read --photosensor--.

Line 64, "the both" should read --both--.

COLUMN 6

Line 19, "of a" should read --a--.

Line 21, "even" should read --even if--.

COLUMN 7

Line 26, "residua-ink" should read --residual-ink--.

COLUMN 8

Line 19, "part" should read --parts--.

UNITED STATES PATENT AND TRADEMARK OFFICE

CERTIFICATE OF CORRECTION

PATENT NO. : 5,900,888

DATED : May 4, 1999

INVENTOR(S) : YUJI KUROSAWA

It is certified that error appears in the above-identified patent and that said Letters Patent is hereby corrected as shown below:

COLUMN 9

Line 40, "only once." should read --set only once.--

COLUMN 10

Line 66, "small-amount" should read --small amount--.

COLUMN 14

Line 53, delete "of external light".

COLUMN 16

Line 39, "walls" should read --the walls--.

Signed and Sealed this

Eleventh Day of April, 2000

*Attest:*

*Attesting Officer*

Q. TODD DICKINSON

*Director of Patents and Trademarks*